US008517236B2

(12) United States Patent
Kushner

(10) Patent No.: US 8,517,236 B2
(45) Date of Patent: Aug. 27, 2013

(54) PERSONAL ARTICLE HOLDER WITH DISPENSER

(76) Inventor: Robert Gerald Kushner, Mid-Levels (HK)

( * ) Notice: Subject to any disclaimer, the term of this patent is extended or adjusted under 35 U.S.C. 154(b) by 1866 days.

(21) Appl. No.: 10/852,634

(22) Filed: May 24, 2004

(65) Prior Publication Data

US 2005/0098592 A1 May 12, 2005

Related U.S. Application Data

(63) Continuation-in-part of application No. 10/712,792, filed on Nov. 12, 2003, now abandoned.

(51) Int. Cl.
*A44B 21/00* (2006.01)

(52) U.S. Cl.
USPC ..... 224/247; 224/269; 224/312

(58) Field of Classification Search
USPC ..... 224/278, 148.4, 269, 247, 536, 570, 224/461, 312, 4.22; 220/4.22
See application file for complete search history.

(56) References Cited

U.S. PATENT DOCUMENTS 2,890,816 A * 6/1959 Horland ..... 222/142.3
3,668,802 A * 6/1972 Benward ..... 43/57.1
4,288,006 A * 9/1981 Clover, Jr. ..... 222/42
4,336,882 A * 6/1982 Sakwa ..... 206/537
5,318,183 A * 6/1994 Cohen et al. ..... 206/538
5,676,285 A * 10/1997 Vinarsky ..... 224/148.1
5,697,127 A * 12/1997 Tyler ..... 24/3.7
5,762,199 A * 6/1998 Aguilera ..... 206/533
5,794,312 A 8/1998 O'Mahony
5,941,487 A 8/1999 Keely
5,975,476 A 11/1999 Mancinelli
5,983,459 A 11/1999 Goldenberg
6,101,689 A * 8/2000 Jo ..... 24/338
6,134,753 A 10/2000 O'Mahony
6,210,003 B1 4/2001 Chan
D466,288 S 12/2002 Koo
6,564,432 B1 5/2003 Kushner
6,631,805 B2 * 10/2003 Bramen ..... 206/538
6,669,020 B1 * 12/2003 Mamiye ..... 206/438
6,681,452 B1 * 1/2004 Holland ..... 24/67.3
6,726,054 B2 * 4/2004 Fagen et al. ..... 221/45
6,728,995 B2 * 5/2004 Ainley et al. ..... 24/3.3

FOREIGN PATENT DOCUMENTS

JP 10226279 A * 8/1998

* cited by examiner

*Primary Examiner* — Justin Larson

(57) ABSTRACT

A personal article holder includes a clamping body having a clamping position and an open position. The clamping body also includes an upper arm and a lower arm pivotally connected at one end thereof to a corresponding end of the upper arm such that personal articles may be retained between the upper and lower arm. The holder may further include a cavity formed therein or surface for storage of one dispensable items and an attachment mechanism connected to the clamping body for attaching the clamping body to a desired surface. The dispensable items may include medicine, mints, gum, candy or other items a user may want do dispense.

17 Claims, 8 Drawing Sheets

PERSONAL ARTICLE HOLDER WITH DISPENSER

CROSS-REFERENCE TO RELATED APPLICATIONS

This application is a continuation-in-part application of U.S. application Ser. No. 10/712,792 entitled "Personal Article Holder with Accompanying Tool" filed by the same inventor on Nov. 12, 2003 now abandoned.

BACKGROUND OF THE INVENTION

1. Technical Field

The present invention generally relates to a device for holding personal articles such as eyeglasses and the like. More particularly, but not exclusively, the present invention relates to a device that holds eyeglasses or sunglasses, pens, pencils or any other small object and includes capabilities for dispensing items such as medicines or confections. The device may be attached to any surface such as appliances, furniture, computers, clothing, clothing accessories and flat surfaces such as automobile visors and books where a user may stow personal articles in the device and/or access items for dispensing from the device.

2. Background Art

BRIEF SUMMARY OF THE INVENTION

Many people periodically wear eyeglasses and/or sunglasses. However, at certain times, a wearer of eyeglasses or sunglasses (collectively referred to herein as "glasses") may wish to remove and store their glasses for short periods when the glasses are not needed. For example, a wearer of sunglasses may remove them during evening hours when sunlight begins to fade. The wearer may typically remove them and place them in a convenient location such as on the dashboard of the car, on an adjacent seat, in a cubbyhole or the like. These locations, while convenient, may subject the glasses to be susceptible to soiling, damage and/or loss. Consequently, there is a need for a holder of personal articles, including glasses, which conveniently stores such items to prevent soiling, damage and/or loss.

Many attempts to provide such a holder have been made, some more successful than others. For example, U.S. Pat. Nos. 6,134,753 and 5,794,312 to O'Mahony disclose holding devices including a clip portion for attaching the holding device to a desired surface and a clamping portion for securing the personal article or glasses.

U.S. Pat. No. 5,941,487 to Keely discloses a retainer for holding eyeglasses that includes a retainer ring rotatably mounted to a clamping means. The clamping means secures the retainer to a desired surface, such as a automobile visor, while the retainer ring receives and secures the temple portion of a pair of eyeglasses.

U.S. Pat. No. 5,975,476 to Mancinelli discloses a holder for securing eyeglasses to a visor including a body and a clip. The body receives the bridge of the eyeglasses with the temple bars of the glasses resting on top of the body. The clip is disposed on a portion of the body and forms a flexible clamp for securing the holder to a visor.

U.S. Pat. No. 5,983,459 to Goldenberg discloses a clip for securing eyeglasses or sunglasses that slides onto an article of clothing. The clip is similar to a conventional money clip but has an elastic material to create a channel for receiving a temple of a pair of glasses.

U.S. Pat. No. 6,210,003 to Chan discloses a personal article holder having a clamping body and a visor clip. And U.S. Pat. No. 6,564,432 to Kushner, which is incorporated herein by reference, discloses a personal article holder having a clamping body and a display window disposed on the clamping body for displaying desired images.

While these and other known retainers and holders for glasses and other articles may provide effective for protecting such items against loss, damage or soiling, they do not include a built in tool or accessory which may be utilized by a user in addition to stowing personal articles. Further, these articles do not have the capability of stowing items to be dispensed. For example, many medications require pills or capsules to be taken in specified time periods throughout the day. It may thus be desirable to be able to store containers or dispensers containing medications in a convenient location which can be moved from place to place.

Accordingly, it is desired to provide a personal article holder that not only is capable of holding personal articles for a user but also includes a dispensing accessory that may be removed from the personal article holder and utilized by the user.

SUMMARY OF THE INVENTION

According to one aspect of the present invention a personal article holder includes an upper arm member hingedly connected to a lower arm member via a pivot mechanism and an attachment mechanism for attaching the personal article holder to desired surfaces. The personal article holder also includes a cavity for retaining one or more tools or dispensing accessories. The tool may include a calculator, paper and a writing utensil, a screwdriver, a lens cleaning device such as a microfiber cloth and/or a lens cleaning solution or any other tool or accessory which may be desirable to stow in a specified location. The dispensing accessory may include, by way of example only, an integrated or removable candy dispenser, medicine dispenser, tissue dispenser, stamp dispenser or other type of container which may retain items for dispensing.

In certain embodiments, the personal article holder thus provides a first storage location for storage of a user's personal article between a clamping body and a second storage location for a tool or dispenser.

In other embodiments, the personal article holder includes the tool or dispenser stored in the second storage location.

BRIEF DESCRIPTION OF THE SEVERAL VIEWS OF THE DRAWING

Further aspects, features and advantages of the present invention will become apparent from the following description of the invention in reference to the appended drawing in which like numerals denote like elements and in which.

DETAILED DESCRIPTION OF THE INVENTION

A personal article holder with dispenser or accompanying tool according to one embodiment of the invention includes: a clamping body for securing the personal article and an attachment portion for securing the clamping body to a desired surface. The clamping body may generally include: (i) an upper arm member hingedly connected on one end to (ii) a lower arm member. On an opposite, non-hinged, end of the upper and lower arm members is a clasp device for securing the upper arm member to the lower arm member between closed and open positions. The upper and lower arm members may each include a resilient cushion member that, when the clamping body is in a closed position, oppose each other to secure personal articles placed there between.

The upper arm member may include, on a side opposite its respective cushion member and/or along its side, a cavity for stowing a dispenser or tool. The attachment portion may be secured on the lower arm member, opposite the side of its respective cushion member, so that, when attached to a surface, e.g., a car visor, refrigerator, or other surface, the cavity for stowing the tool or dispensable items is accessible or viewable by a person.

Figure 1:
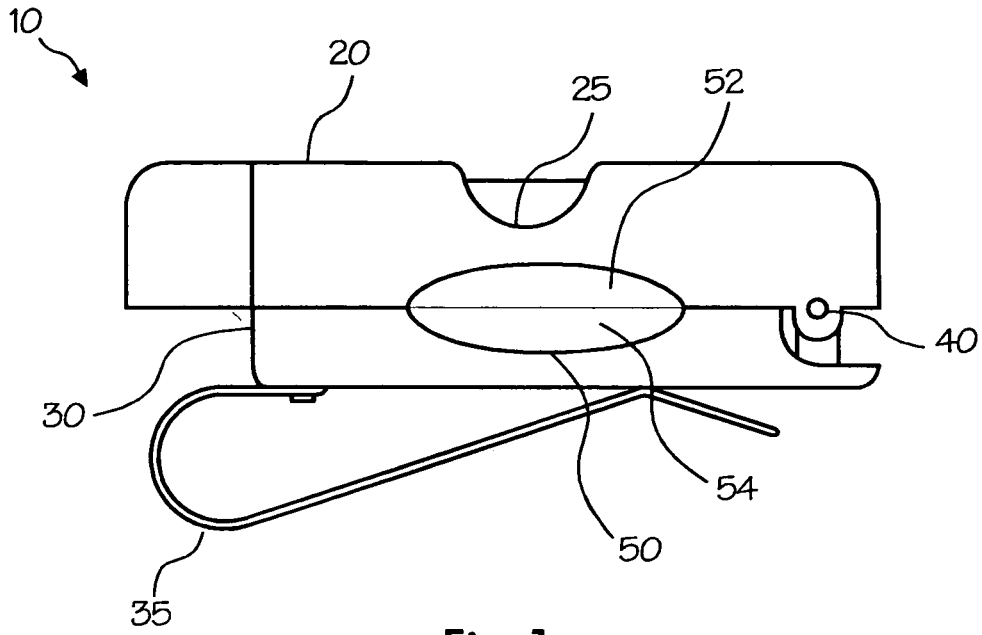
FIG. 1 is a side view of a personal article holder with embedded tool according to one aspect of the present invention.

Referring to FIGS. 1-4, a preferred example of a personal article holder with accompanying tool will now be described. FIG. 1 illustrates a side view of a personal article holder 10 with accompanying tool including a clamping body including upper arm 20 and lower arm 30 connected at one end by a pivot or hinge 40. The clamping body may include a space 50 between the upper arm 20 and lower arm 30 for securing portions of a personal article in holder 10. An attachment portion 35 may be fixed to one of arms 20, 30 of the clamping body so that the clamping body may be attached to a variety of different surfaces.

Figure 2:
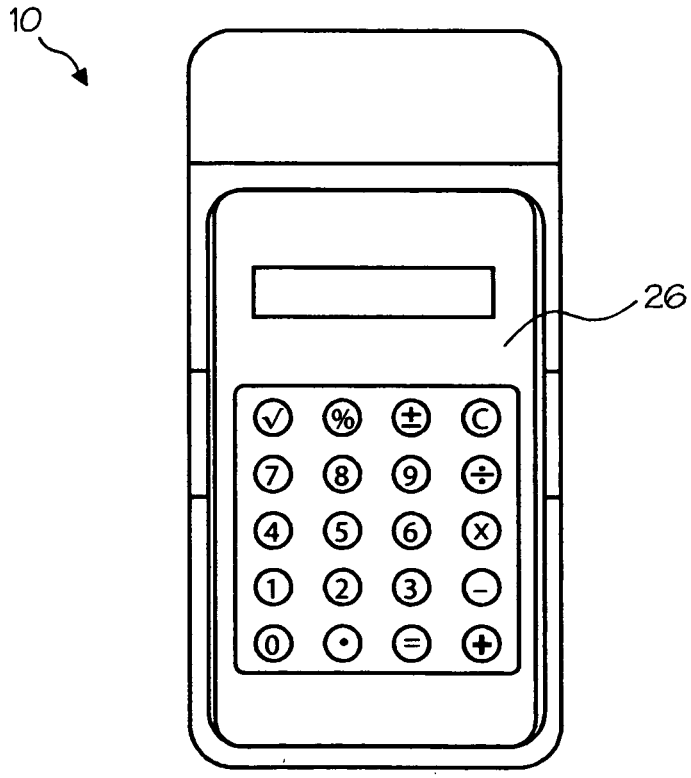
FIG. 2 is a top view of the personal article holder of FIG. 1.
Figure 4:
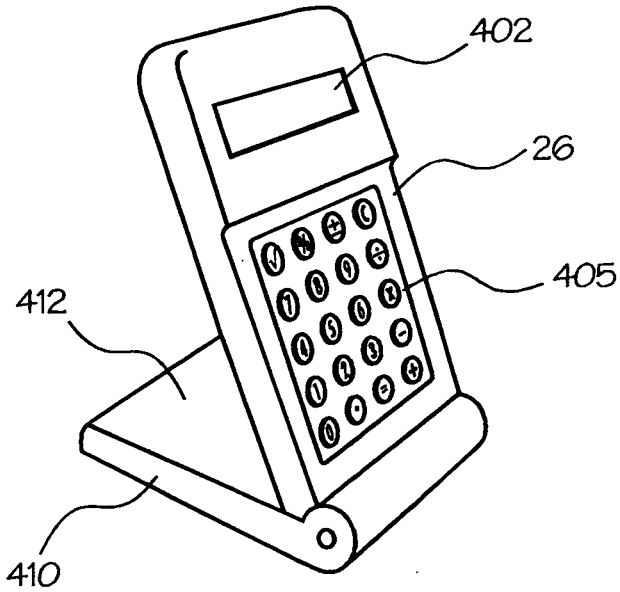
FIG. 4 is a perspective view of a tool which is removably insertable into the personal article holder of FIG. 3.

Upper arm 20 includes one or more cavities 25 for retaining a tool 26 (for example, a calculator in FIGS. 2 & 4). As used herein, a "tool" means an object that aids in accomplishing a task. While various example tools are described herein, the present invention is not limited to any particular type or category of tool. Cavity 25 may be a hollowed portion in holder 10 and tool 26 may be retained therein by virtue of one or more indentation and/or tabs on the cavity and/or tool.

Figure 3:
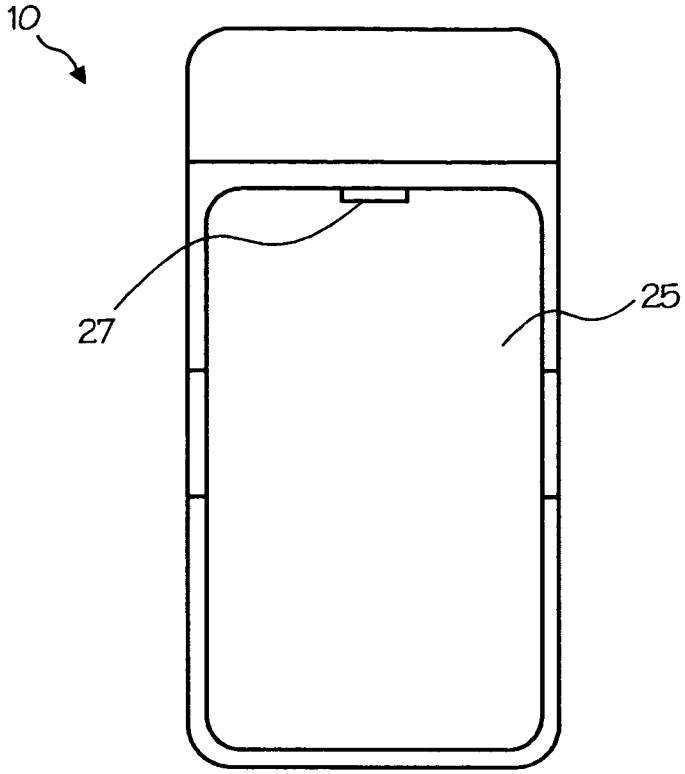
FIG. 3 is a top view of the of the personal article holder of FIG. 1 with the tool removed.

FIGS. 3 and 4 illustrate views of holder 10 and tool 26 removed from cavity 25. In one embodiment, tool 26 is a calculator, digital voice recorder or other electronic device that may assist a user. In one implementation (FIG. 4), calculator 26 includes a display 402, a keypad 405, a processor (not shown) and an optional rotating panel 410. Display 402, keypad 405, and the processor are conventional components and thus not described in detail. Rotating panel 410, if included, serves two primary functions: (i) in a first position (shown in FIG. 4) panel 410 serves as a stand for calculator 26; and (ii) in a second position (not shown) panel 410 serves as a protective cover for display 402 and/or keypad 405. In this embodiment, panel 410 covers keypad 405 when calculator 26 is stowed in cavity 25. A top surface 412 of rotating panel 410 may also be used as a surface for an advertisement or promotion as it will be prominently displayed when calculator 26 is stowed in holder 10.

Referring back to the side view in FIG. 1, holder 10 also preferably includes one or more cushion members 52 and 54 for gently but securely stowing portions of a personal article disposed in space 50 when holder 10 is in a closed position. As shown, upper arm 20 has cushion member 52 disposed on a lower or inside surface thereof. Conversely, lower arm 30 has cushion member 54 disposed on an upper or inside surface as well. Cushion members 52 and 54 may be fixed or removably attached to respective arms 20, 30 in any manner for one material to be secured to another, e.g., snaps, adhesive, VELCRO®, etc. In one embodiment, cushion members 52 and 54 are fixed to the interior of the upper and lower arms using an adhesive. When the clamping body is in a closed position (depicted in FIG. 1), cushion members 52 and 54 may abut against one another or be separated by a small space for gripping a portion of a personal article placed there between.

Upper arm 20 and lower arm 30 of the clamping body may be made from any material rigid enough to provide support for a personal article, such as rigid plastics, ceramics, metals, woods or any combination thereof. In one embodiment, upper and lower arms are formed in an injection mold using an ABS (Acrylonitrile-Butadience-Styrene) plastic material, which may be tinted or colored to achieve a desired color. ABS plastics are used in preferred embodiments since they possess high strength and durable material characteristics and readily accept plating and painting to vary appearance and design of the device. The clamping body may be formed in any desired shape such as a circle, an oval, a rectangle, a square, a trapezoid or any other symmetrical or asymmetrical shape and may be any size or color desired.

Cavity 25 is preferably formed during injection molding of holder 10 (provided holder 10 is made from an injection molded plastic or resin) and is a recess or depression formed to accommodate a shape of the accompanying tool. As shown in FIG. 3, cavity 25 is formed in the same general shape as calculator 26 (FIG. 4) and retains calculator 26 via a tab or recess 27. There may also be more than one cavity and/or the cavity may be covered by a panel as described in other embodiments below.

Pivot 40 may be any type of rotating connector between upper arm 20 and lower arm 30. In one embodiment pivot 40 comprises an axial pin disposed through holes formed in the injection mold plastic of the respective upper and lower arms. In another embodiment, pivot 40 comprises divots or holes in an end of one arm (upper or lower) and corresponding protrusions in the opposite arm that mate with the divots or holes.

Attachment portion 35 may be any mechanism or arrangement for facilitating temporary or permanent fixation of clamping body to other surfaces. Examples of attachment portion 35 include a clip, a magnet, VELCRO®, a suction cup, double sided tape, etc. In one embodiment, attachment portion 35 is a tensioned wire attached to lower arm 30 similar to, but not limited to, the example shown in FIG. 1. With this arrangement, holder 10 may be utilized as a bookmark by clipping a desired portion of a book between wire 35 and lower arm 30. In another embodiment attachment portion 35 is a segment of double-sided tape (not shown) having one side adhere to the clamping body and readily attachable to a desired surface, such as a computer monitor, using the adhesive opposite side.

Figure 5:
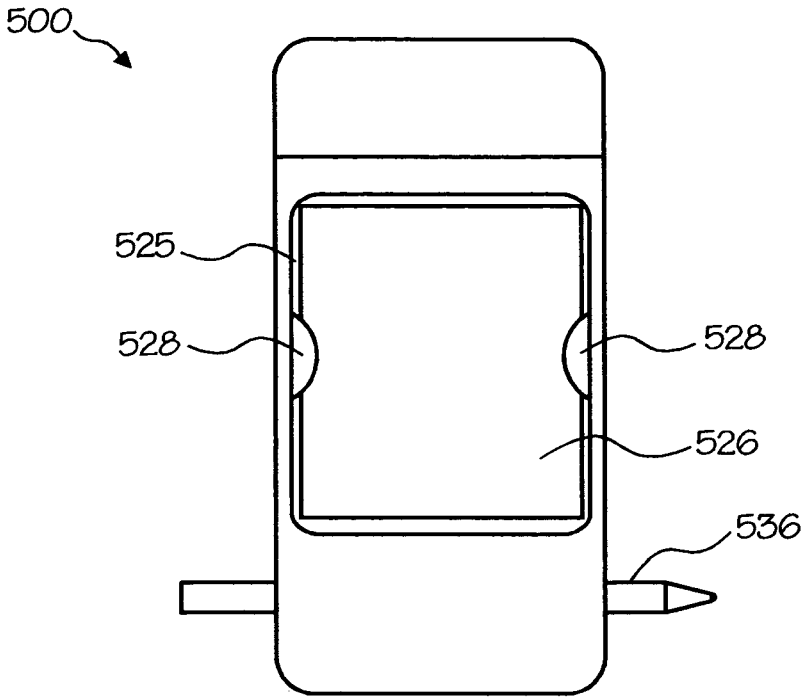
FIG. 5 is a top view of a personal article holder according to another aspect of the present invention.

FIG. 5 illustrates an embodiment of the present invention in which a personal article holder 500 includes two cavities; a first cavity 525 for retaining a removable writing surface 526 such as a pad of paper or POST-IT® type notes, and a second cavity (not shown) for retaining a writing tool 536 such as a pencil or pen. The first cavity 525 is preferably conformed to a shape of the writing surface 526 and includes one or more tabs 528 for retaining writing surface 526 inside cavity 525. The second cavity may be formed as a hole through the sides of one of the arms 20, 30 (FIG. 1), for example, using a hole through the respective cushion member 52, 54 having a smaller diameter than writing tool 536 and thus bias writing tool 536 in place. Alternatively, or in addition, a cavity for retaining writing tool 536 may be formed by a recess in the injection molded plastic as discussed with respect to the screwdriver embodiment below. One or more clips for holding writing tool 536 could also be used.

Figure 6:
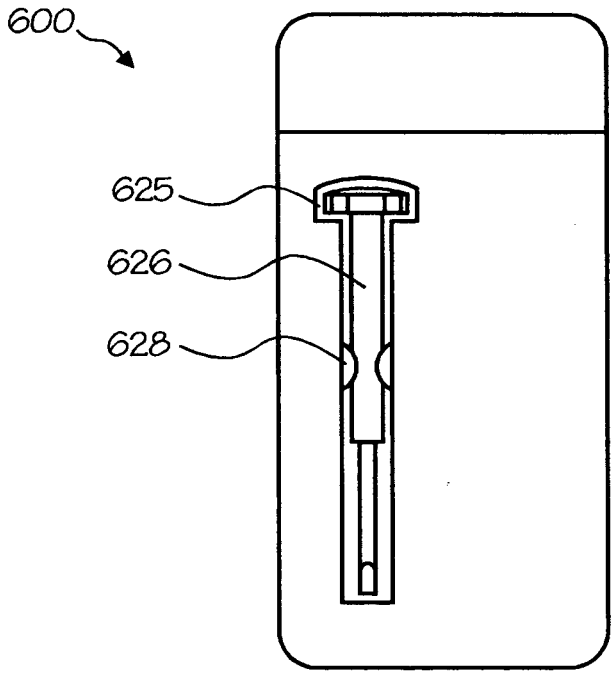
FIG. 6 is a top view of a personal article holder according to a third aspect of the present invention.

FIG. 6 illustrates another embodiment of the invention in which a cavity 625 is formed in a personal article holder 600 in a shape to receive a screwdriver and/or wrench. In this embodiment, one or more tabs 628 are formed along an edge of cavity 625 such that a tool (such as screwdriver 626) snaps into and is retained in cavity 625. Finger recesses (not shown but refer to FIG. 1) may also be included to enable a user to grasp and/or remove tool 626 while in its stowed position.

Figure 7:
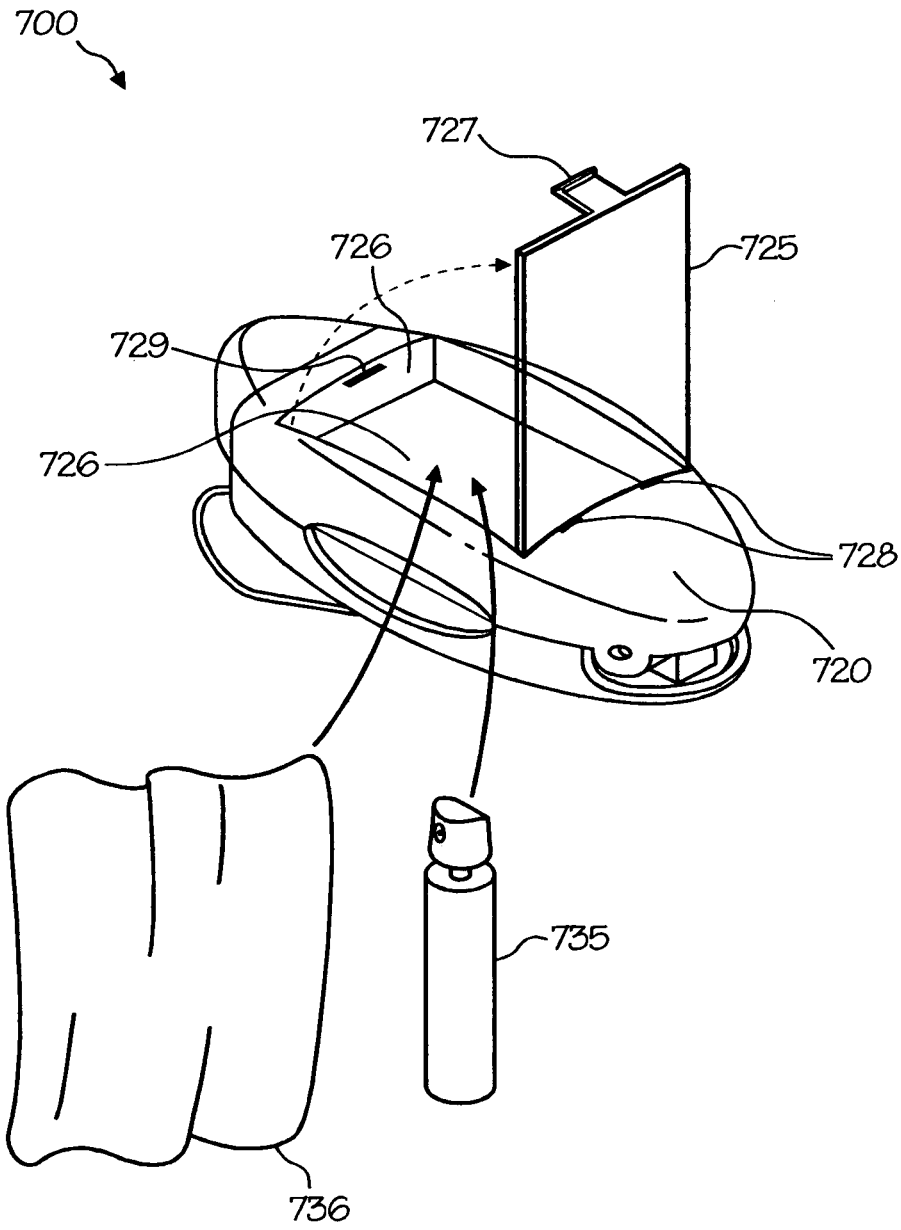
FIG. 7 is a perspective view of a personal article holder according to a fourth aspect of the present invention.

Turning to FIG. 7, in another embodiment of the present invention, a personal article holder 700 includes a cavity 726 shaped and/or dimensioned to accommodate one or more tools 735, 736. In this embodiment, cavity 726 is formed in one clamping arm of holder 700 and an access panel 725 is then provided to cover cavity 726 so that the user, when desired, may access and/or store tools such as lens cleaning cloth 736 or spray cleaning solution bottle 735. In this embodiment, cavity 726 and panel 725 collectively form a compartment for containing one or more tools.

Panel 725 may be opaque or transparent and may be hingedly connected to upper arm 720 on one end, e.g., using hinges 728. On an opposite end of panel 725 may be a tab 727 for securing into slot 729 located in arm 720. Slot 729 may include a release mechanism (not shown) for releasing and securing tab 727 of panel 725. Hinges 728 may be any type of arrangement for facilitating rotation of panel 725 between open and closed positions. In one embodiment, hinges 728 are C-shaped plastic extensions of panel 725 that rotate around corresponding axial members formed in upper arm 720. In other embodiments, tabs are used in place of hinges 728 so that panel 725 completely removes from holder 700 for access to cavity 726. Other securing and/or attachment arrangements are also possible.

While panel 725 is illustrated in FIG. 7 as a rectangular shaped panel, it should be recognized that it may be formed in any desired shape including, for example, ovals, circles, squares and any other symmetrical or asymmetrical shape. In one implementation of the present invention, panel 725 is a transparent material and may include a slot (not shown) for inserting pictures or an insert for viewing when panel 725 is in a closed position.

In addition to the cavities which retain the tools as described above, the personal article holders of the present invention will serve to hold a personal article, for example eyeglasses, in the clamping body, as is well known in the art.

Figure 8:
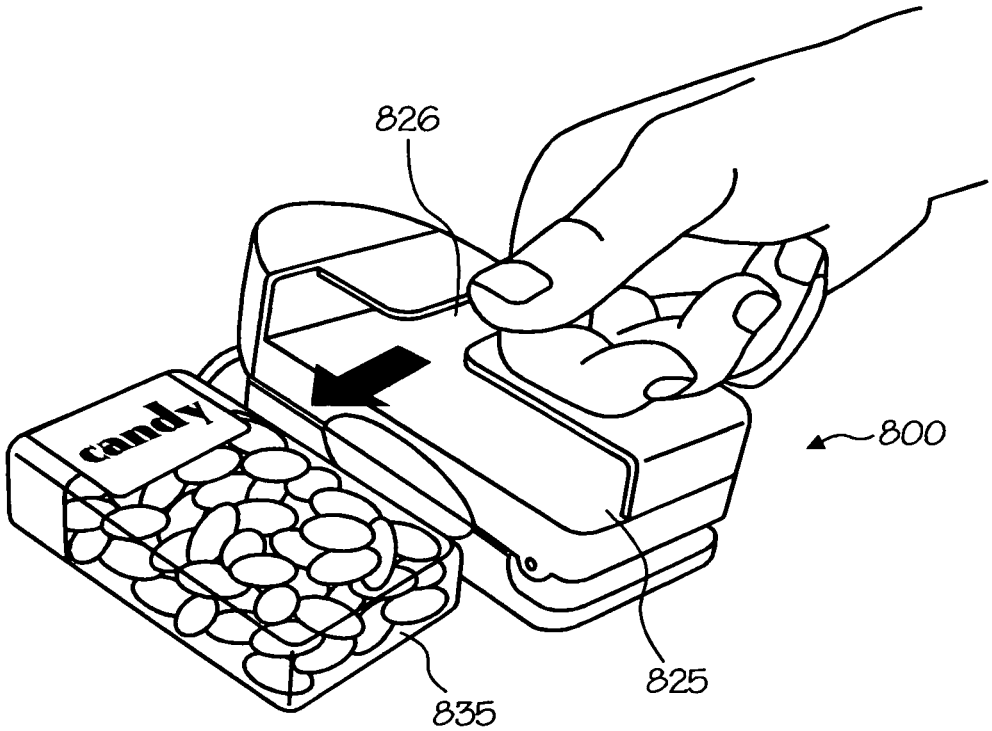
FIG. 8 is a perspective view of a personal article holder according to a fifth aspect of the invention.

Turning to FIG. 8, a personal article holder 800 according to other embodiments of the present invention may include a cavity 825 for holding or retaining dispensable items (e.g., dispenser 835). Dispensable items may include but are not limited to candies, mints, breath strips, gum, medicine tablets, stamps, tissues, business cards, photos, money, dental floss, cosmetic goods such as cotton swaps or lipstick or other items. In certain preferred embodiments, cavity 825 may be formed in a shape to retain a specific commercially available dispensers 835 (e.g., a TIC-TAC® container, PEZ® container, or breath strip container). Holder 800 may further include a dispenser access area 826 to assist a user in removing dispenser 835 from cavity 825. In other embodiments a dispenser may be integrated with the cavity.

As with any of the embodiments described herein, the personal article holder does not necessarily require a cavity for holding tools or dispensers, rather, the personal article holders may be configured so that tools or dispensers may be attached to one or more of its surfaces. For example, a tool or dispenser may be attached to a surface using double-sided tape, VELCRO, magnet, clip, wire retainer or other attachment mechanism without requiring a cavity formed in a surface of the personal article holder.

Figure 9:
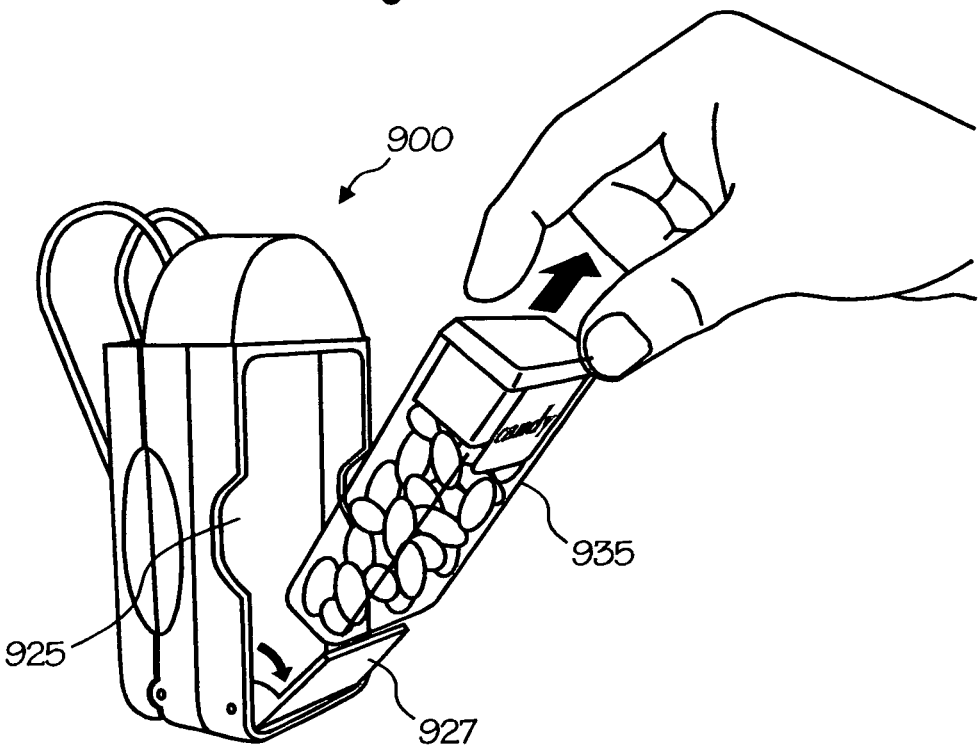
FIG. 9 is a perspective view of a personal article holder according to a sixth aspect of the invention.

Referring to FIG. 9, in a modified embodiment a personal article holder 900 may include one or more tabs or movable panels 927 for retaining a dispenser 935 in a stowed position within a cavity 925.

Figure 10:
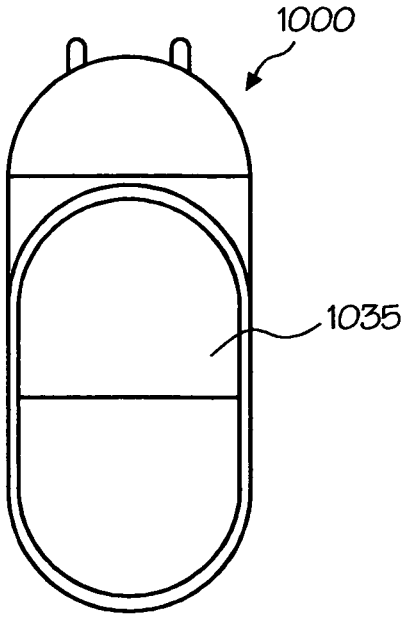
FIG. 10 is a perspective view of a personal article holder according to a seventh aspect of the invention.
Figure 11:
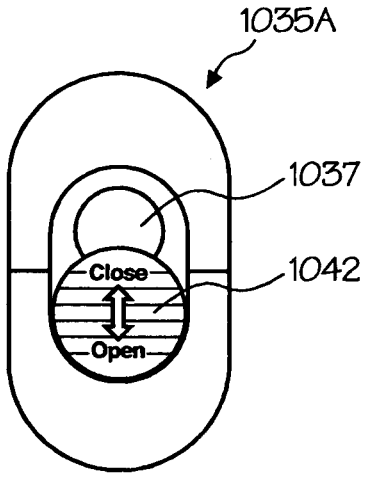
FIG. 11 is a bottom view of a dispenser according one of the invention.
Figure 12:
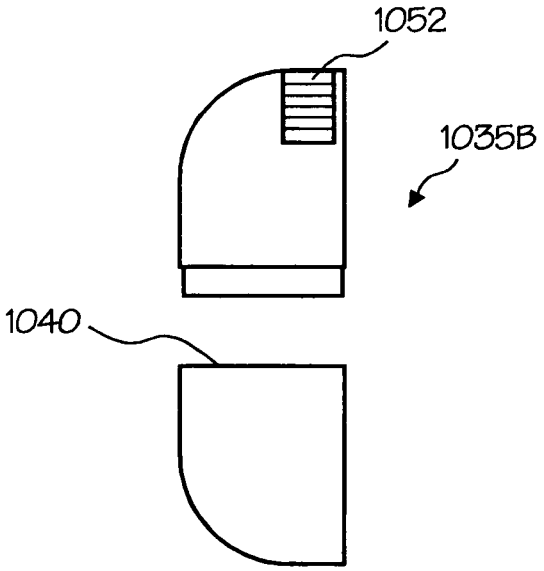
FIG. 12 is a side view of a dispenser according another aspect of the invention.

Turning to FIGS. 10-12, embodiments for a personal article holder 1000 are similar to those previously described although holder 1000 may include a dispenser 1035 for dispensing tablets or capsules (e.g., medicine or vitamins). FIG. 10 shows a top view of holder 1000 including a dispenser 1035 which may be integrated with, or removable from, holder 1000. FIG. 11 shows a bottom view of a removable dispenser 1035A and FIG. 12 shows a side view of an alternately configured removable dispenser 1035B.

Dispenser 1035 may have any number of configurations, shapes or sizes. In certain preferred embodiments, dispenser 1035 may be configured to include one or more openings (e.g., 1037, FIG. 11; 1040, FIG. 12) for placing tablets in and/or removing tablets from dispenser 1035. Additionally, dispenser 1035, 1035A and/or 1035B may include one or more lids (e.g., 1042, FIG. 11; 1052, FIG. 12) for providing access to and/or dispensing pills residing inside. Lid 1042, 1052 may be configured for sliding, screwing or popping open or closed in response to user initiated action.

Figure 13:
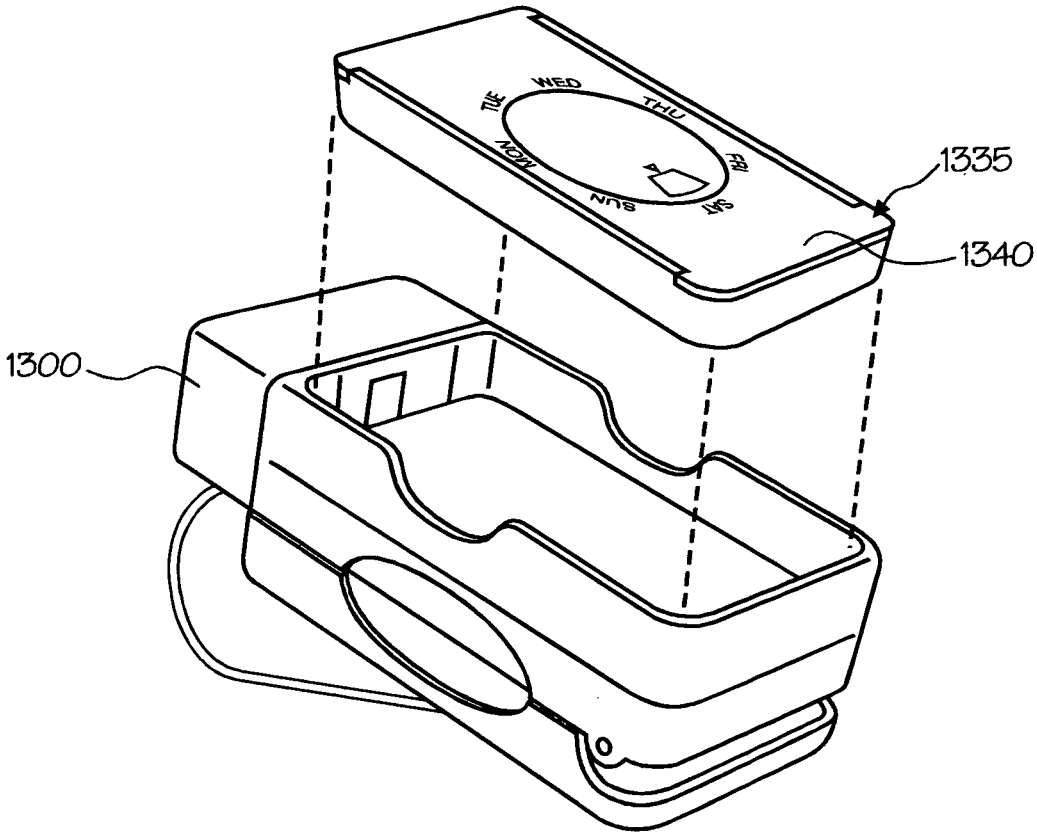
FIG. 13 is a perspective view of a personal article holder according to yet another aspect of the invention.
Figure 14:
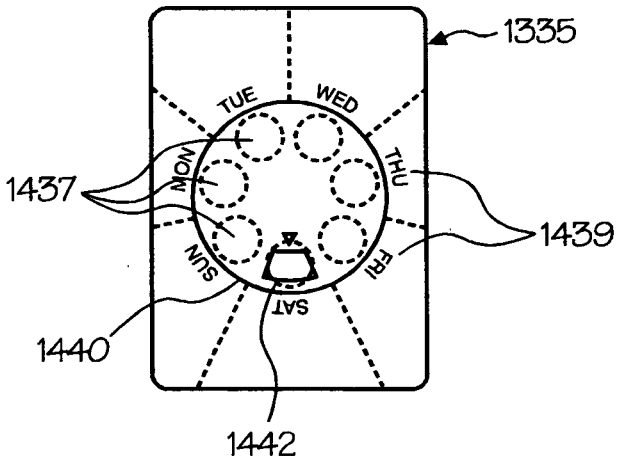
FIG. 14 is a top view of a dispenser according to another aspect of the invention.

Turning to FIGS. 13 and 14, a personal article holder 1300 according to another embodiment of the present invention may include a multi-day dispenser 1335 having multiple storage locations 1437 for storing and/or dispensing tablets or capsules in separate locations.

In one exemplary embodiment, multi-day dispenser 1335 may include seven storage locations 1437 and indicators 1439 corresponding to days of the week. Dispenser 1335 may further include, if desired, a sliding or rotating panel 1440 having an access opening 1442, that when placed in an appropriate position, enable access to one of the storage locations 1437 for dispensing a provided tablet or capsule stored inside. Dispenser 1335 may be integrated with, removable from or attachable to a surface of the personal article holder and, in certain embodiments, may further include a lid 1340 which may be opened to access all storage locations 1437 at the same time (e.g., for inserting medications or vitamins into the dispenser).

Figure 15:
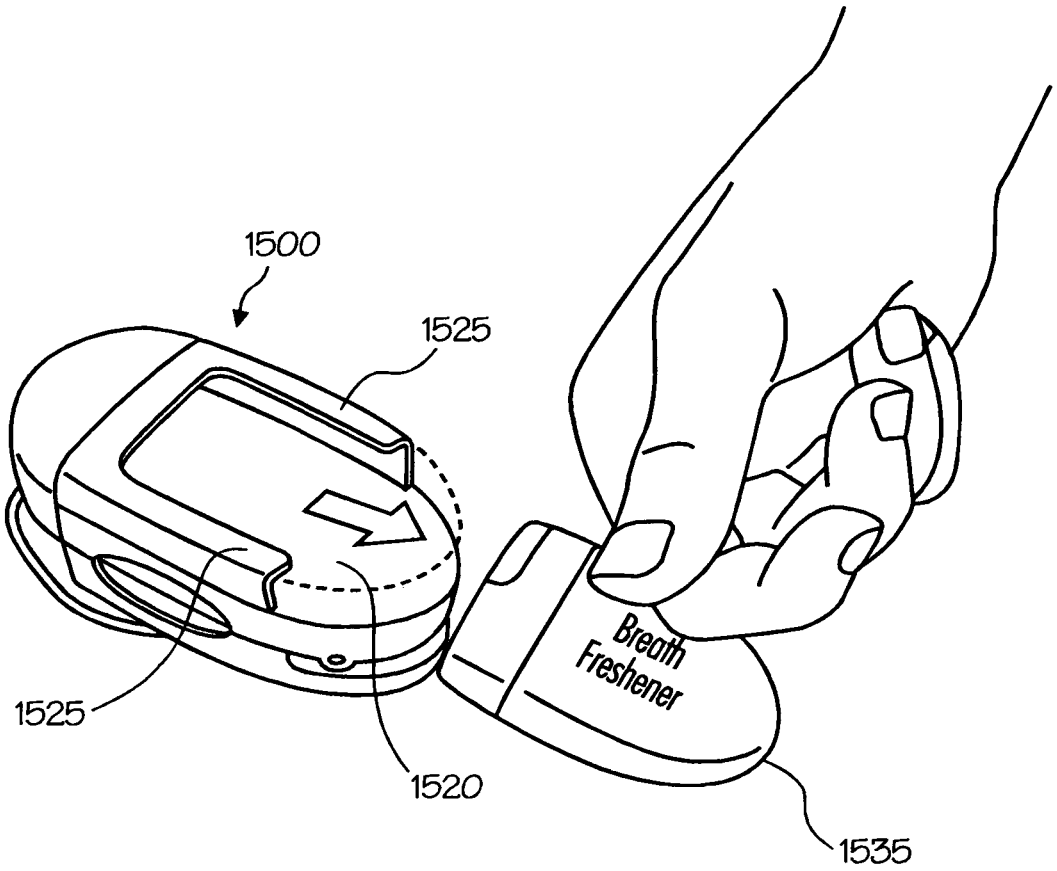
FIG. 15 is a perspective view of a personal article holder configured to retain a commercially available dispenser.

Referring to FIG. 15, a personal article holder 1500 according to yet another aspect of the invention includes a surface 1520 configured to retain a commercially available dispensers 1535 of breath fresheners such as ICE BREAKERS® brand liquid capsules or LISTERINE® brand gelatin strips. In certain embodiments surface 1520 is configured to have walls 1525 formed to retain the commercially available dispenser 1535. In other embodiments, surface 1525 may include a tacky strip, magnet, VELCRO, double-sided tape or other means for retaining dispenser to holder 1500.

It should be recognized that the specific arrangements and configurations for various holders and dispenser could vary greatly and the embodiments of the present invention are not limited to any particular configuration or arrangement shown in the example embodiments.

Unless contrary to physical possibility, the inventor envisions the components of respective embodiments may be combined in any manner.

Although there have been described preferred embodiments of this novel invention, many variations and modifications are possible and the embodiments described herein are not limited by the specific disclosure above, but rather should be limited only by the scope of the appended claims.

What I claim is:

1. A holder for supporting and securing objects, the holder comprising:

an upper arm member having a first cushion disposed on a bottom side thereof and a cavity disposed on a top side thereof, said cavity including a side opening; a dispenser inserted into the side opening of the cavity;

a lower arm member including a second cushion member, the lower arm member having side thereof hingedly attached to a corresponding end of the upper arm member such that the upper and lower arm members form a clamping body having a hinge at one end and a latching mechanism at an opposite end, wherein the first and second cushions oppose one another between the hinged end and latching end to secure objects such as eyeglass temples there between when said upper and lower aim members are in a closed position; and a clip disposed on a surface of the lower arm member opposite the second cushion member, the clip configured to secure the holder to a desired surface;

wherein said dispenser is configured to hold and dispense one or more separately provided dispensable items for human consumption.

2. The holder of claim 1 wherein the dispenser is configured to hold dispensable items comprising at least one of medicine or vitamins.

3. The holder of claim 1 wherein the dispenser is configured to hold dispensable items comprise comprising at least one of gum, candy or breath freshener.

4. The holder of claim 1 wherein the dispenser is configured to retain a commercially available candy, gum or breath freshener dispenser.

5. The holder of claim 1 wherein the upper and lower arm members are formed from an injection mold plastic material.

6. The holder of claim 1 wherein the dispenser is removable.

7. The holder of claim 1 wherein the the dispenser comprises a multi-day dispenser includes a rotating panel having an access opening which facilitates access to the multiple storage locations when the rotating panel is rotated by a user.

8. A clip for temporarily attaching eyeglasses or sunglasses to an automobile visor and dispensing items, the clip comprising:

an first arm member having a first cushion disposed one side thereof and a dispensing area disposed on an opposite side thereof;

a second arm member including a second cushion member, the second arm member having an end thereof pivotally attached to a corresponding end of the first arm member such that the upper and lower arm members form a clamping body wherein the first and second cushions oppose one another to secure an article there between when said upper and lower arm members are in a clamped position; and a spring clip disposed on a surface of the second arm member opposite the second cushion member, the spring clip configured to secure the clip to the automobile visor or similar surface;

wherein said dispensing area is configured with a cavity defining an opening and at least one movable panel which partially covers the opening such that a removable dispenser containing one or more dispensable items for human consumption is held within the cavity by the at least one movable panel.

9. The clip of claim 8 dispensing area comprises a cavity shaped and dimensioned to retain the removable dispenser.

10. The clip of claim 8 wherein the upper and lower arm members are formed from an injection mold plastic material.

11. The clip of claim 8 further comprising the removable dispenser.

12. The clip of claim 11 wherein the removable dispenser comprises a commercially available candy, gum or breath freshener dispenser.

13. The clip of claim 11 wherein the removable dispenser contains at least one of medicine or vitamins.

14. The clip of claim 11 wherein the dispensing area includes a dispenser access area to assist a user in removing the dispenser from the dispensing area.

15. The clip of claim 11 wherein the personal article holder includes one or more movable panels for retaining the dispenser in a stowed position.

16. The clip of claim 11 wherein the removable dispenser includes multiple storage locations for tablets or capsules.

17. The clip of claim 16 wherein the removable dispenser comprises a multi-day dispenser includes a rotating panel having an access opening which facilitates access to the multiple storage locations when the rotating panel is rotated by a user.

* * * * *